United States Patent [19]

Perkins et al.

[11] Patent Number: 4,817,609

[45] Date of Patent: Apr. 4, 1989

[54] METHOD FOR TREATING HEARING DEFICIENCIES

[75] Inventors: Rodney C. Perkins, Woodside; Jason L. Carlson, Portola Valley, both of Calif.

[73] Assignee: Resound Corporation, Palo Alto, Calif.

[21] Appl. No.: 96,129

[22] Filed: Sep. 11, 1987

[51] Int. Cl.[4] ..... H04R 25/00

[52] U.S. Cl. ..... 128/420.6; 381/68.6

[58] Field of Search ..... 128/1 R, 420.5, 420.6, 128/784; 381/68, 68.6

[56] References Cited

U.S. PATENT DOCUMENTS

| | | | |
|---|---|---|---|
| 3,527,901 | 9/1970 | Geib | 381/68.6 |
| 3,764,748 | 10/1973 | Branch et al. | 128/420.6 |
| 4,584,437 | 4/1986 | Giannetti | 381/68.6 |
| 4,592,359 | 6/1986 | Galbraith | 128/420.6 |
| 4,606,329 | 8/1986 | Hogh | 128/420.6 |
| 4,657,106 | 4/1987 | Hardt | 381/68.6 X |
| 4,680,799 | 7/1987 | Honneberger | 381/68.6 |
| 4,735,759 | 4/1988 | Bellafiore | 381/68.6 X |

OTHER PUBLICATIONS

Nonley et al., "A New Design for an Implantable Hearing Aid", *ISA Transactions*, 15 (pp. 242≧245), 1976.

Preres, "Stepped Bone Earmolds . . . ", *Hearing Inst.*, vol. 31, No. 10, 10/80, pp. 24–25.

*Primary Examiner*—Edward M. Coven

*Attorney, Agent, or Firm*—Fitch, Even, Tabin & Flannery

[57] ABSTRACT

A method and apparatus are described for treating hearing impairment in a human. The external auditory canal is substantially enlarged surgically in region proximate the ear drum. An electronic hearing aid is placed in this region. The hearing aid has a external housing molded to conform with the shape of the surgically enlarged region.

3 Claims, 3 Drawing Sheets

METHOD FOR TREATING HEARING DEFICIENCIES

This invention relates to the treatment of hearing impairment in humans. More particularly, the invention relates to an improved method and an improved electronic hearing aid for effecting such treatment.

Two common types of hearing aids are the so-called bone conduction devices and devices which directly stimulate the tympanic membrane or ear drum. A third type of device, utilized for direct neural stimulation, is also sometimes employed. All three devices have their strengths and weaknesses insofar as their effectiveness in the treatment of hearing impairment. Probably the most commonly used of these devices is the air conduction type of device, which uses a speaker to vibrate the air in the ear canal adjacent the tympanic membrane.

The air conduction type of hearing aid generally employs suitable electronics for amplifying incoming sound waves, perhaps also with some processing of the sound waves to change the shape of the response curve. Reproduction of such sound waves by the speaker stimulates the tympanic membrane.

Another type of hearing aid, which also stimulates the tympanic membrane, employs a varying magnetic field. The magnetic field displaces a piece of magnetic material fixed to the lateral surface of the membrane, thus displacing the membrane itself.

Many persons who could benefit from the use of air conduction or magnetic hearing aids refuse to utilize them. Typically, this refusal is based upon a perceived stigma associated with hearing aids. Because most air conduction or magnetic type hearing aids are readily visible on the wearer, despite advances in miniaturization, and because many people associate hearing loss with aging and enfeeblement, the use of such hearing aids is often avoided by persons who need them. In addition, where miniaturization of such devices has been accomplished, such as to reduce visibility, the performance of the device is often compromised.

Many miniaturized air conduction hearing aids are constructed with an outer housing which is molded to conform to the contours of the auditory canal. However, such devices are usually readily visible on the wearer due to the inability to miniaturize such devices to the extent that they may be recessed substantially within the auditory canal as to be not readily visible while still providing the degree of performance necessary to effect a significant improvement in hearing.

It is an object of the present invention to provide an improved method and apparatus for treating hearing impairment in a human.

Another object of the invention is to provide an improved method and apparatus by which a hearing aid of the air conduction or magnetic type may be made essentially invisible on a wearer while still retaining adequate performance to substantially assist hearing.

Another objection of the invention is to provide an improved method and apparatus for constructing and utilizing a miniaturized air conduction or magnetic type hearing aid.

Other objects of the invention will become apparent to those skilled in the art from the following description, taken in connection with the accompanying drawings wherein.

Very generally, in following the practices of the present invention, the external auditory canal of a human patient is substantially and surgically enlarged in a region proximate the ear drum. In the enlarged region, an electronic hearing aid is placed. The hearing aid has an external housing which is molded to conform with the shape of the enlarged region. Accordingly, the hearing aid may be made sufficiently large as to accommodate the electronics necessary for satisfactory hearing assistance, while at the same time remaining invisible to external view of the wearer.

The present invention makes it possible to use a relatively large device, since, due to the surgical enlargement of the auditory canal, more space volume is available for the device, while at the same time permitting the device to be positioned deeply within the auditory canal and thus out of sight. The device is not an implanted device in the sense of many prior art surgically implanted hearing aids, since it is positioned in the auditory canal. Such positioning enables it to be readily inserted and removed for cleaning, adjustment, servicing, etc.

Figure 1:
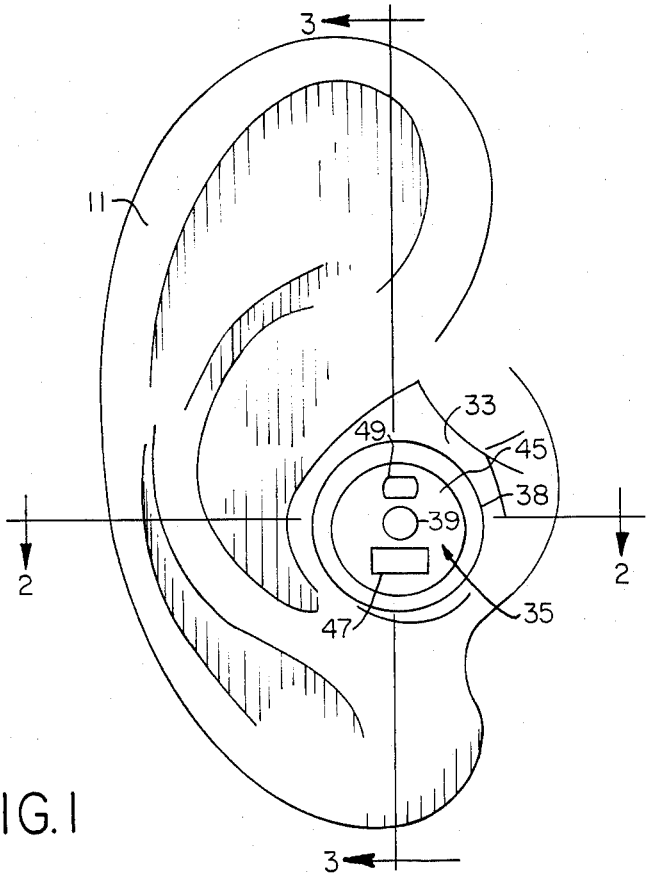
FIG. 1 is a view of the external portion of the right ear of a human wearing the hearing device in accordance with the invention.
Figure 2:
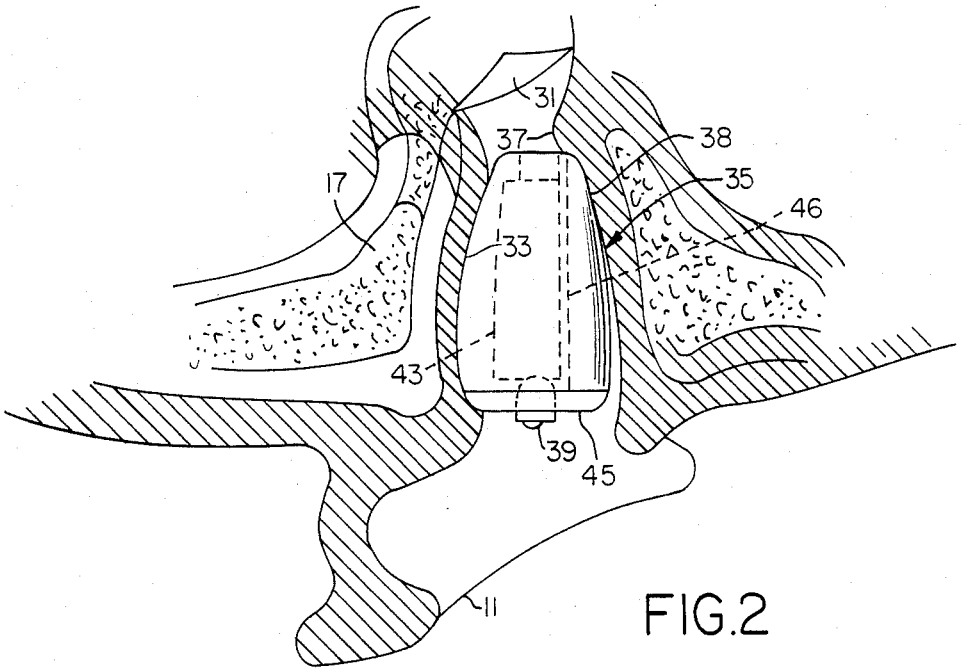
FIG. 2 is a schematic horizontal cross section view of a human ear canal, taken along a plane on the line 2—2 of FIG. 1, illustrating the hearing aid device of the invention in position.
Figure 3:
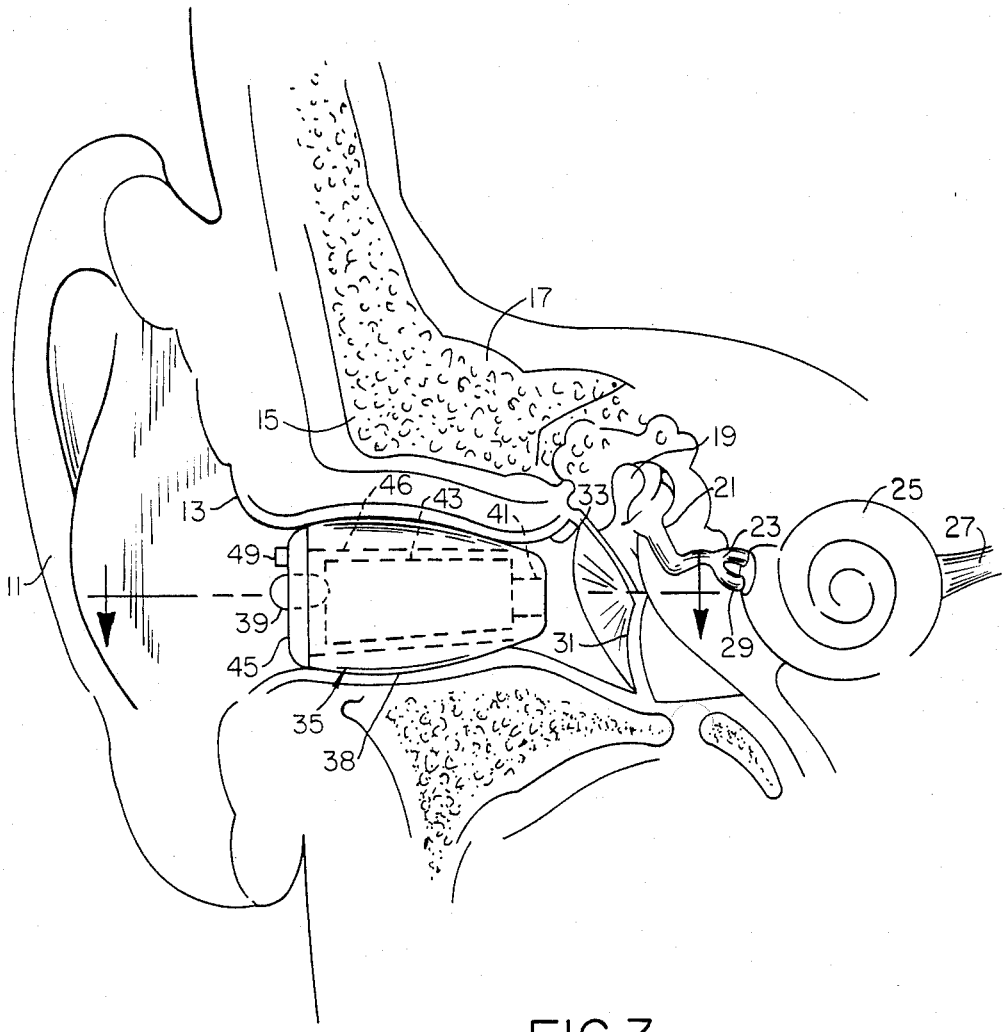
FIG. 3 is a vertical cross sectional view of the ear canal of a human, taken along a plane on the line 3—3 of FIG. 1, illustrating the hearing aid device of the invention in position.

Referring now particularly to FIGS. 1–3, the cross section of the human ear region is illustrated. Visible in the drawings, particularly FIG. 3, are the outer ear flap or pinna, the outer skin and tissue 13, the mastoid area 15, the temporal bone 17, the malleus 19, the incus 21, the stapes 23, the cochlea 25, the cochlea nerve 27, the middle ear promintory 29, the tympanic membrane 31, and the outer auditory canal 33. As is well known, the ossicicular chain comprises a malleus 19 which normally moves in response to the tympanic membrane or ear drum 31. The malleus is in turn connected to the incus 21, which is connected to the stapes 23 which stimulates the cochlea to produce neural transmission via the cochlea nerve 27.

The procedure by which, in accordance with the invention, the outer ear canal is enlarged is designed to be performed by an otolaryngologist trained in the fundamentals of reconstructive ear surgery. The procedure begins with an intraconchal incision and separation of the canal skin from the underlying fibrous and cartilaginous components to be removed. A post auricular incision is made to facilitate recontouring of the bony canal. Canal skin flaps are developed and the bony canal is enlarged and recontoured with suitable burrs and suction irrigation. The canal skin flaps are returned to the new canal, and a bolster is used to maintain adequacy of the meatal opening during healing.

The preferred surgical procedure is as follows:

The ear canal recontour procedure is performed with the patient sedated but awake. The area in and around the ear is cleansed, prepped, and prepared for surgery. Pain is controlled with local injections of analgesics.

The objective of the operation is to remove an adequate amount of the meatal cartilage and subcutaneous fibrous tissue, and bone of the bony portion of the external auditory canal, while maintaining all external auditory canal skin.

An initial crescent shaped incision is made in the lateral surface of the auricular skin and is carried down to the conchal cartilage. The plane between the cartilage and the skin is dissected medially until the medial extent of the posterior meatal cartilage is reached. From that point, sharp dissection is carried medially separating the posterior, superior and inferior canal skin from the deep subcutaneous and fibrous tissue that lies between it and the bony external auditory canal. This dissection is carried medially to the level where the skin becomes more directly adherent to the bone of the canal.

An incision is made through the cartilage about three millimeters medial to the original skin incision and carried superiorly along a line parallel and immediately adjacent to the anterior edge of the antihelix. This incision is then carried more deeply through the subcutaneous meatal fibrous tissue to the bony meatus defining the tissues to be removed later.

Three incisions are then made in the external auditory canal skin. The first begins approximately three millimeters lateral to the pars flaccid area of the tympanic membrane, and is extended laterally into the incisura area of the superior meatus. The second begins about three millimeters from the tympanic annulus at six o'clock and is brought laterally to about 0.5 centimeters beyond the bony cartilaginous junction. A third incision in the posterior canal skin connects the medial extent of the first two incisions.

The posterior canal skin flap, thus delineated, is elevated from medial to lateral with a back angled elevator.

Entering the anterior edge of the superior canal incision, the superior meatal skin is separated from the subcutaneous and fibrous tissue and the anterior superior cartilage with sharp dissection. These tissues are removed.

A post auricular incision is made approximately one centimeter behind the post auricular fold and the skin is elevated from the periostial and fibrous tissue overlying the mastoid bone anteriorly until the Spine of Henle and the posterior bony meatus are encountered. About one centimeter posterior to the Spine of Henle a curvilinear incision is made into the the investing fibrous tissue over the mastoid. The fibrous tissue posterior to this inferior-superior incision is elevated about three millimeters and the fibrous tissue anterior to the incision is removed. The elevated posterior tissue provides a stable anchoring site for a bolster placed near the end of the procedure.

The posterior canal skin flap developed earlier is then lifted out of the canal and folded laterally on its pedicle to reside temporarily within the meatus. The post-auricular incision is held open and the posterior canal skin flap is held in place within the meatus with a self retaining retractor, for example, a Perkins' Tympanoplasty Retractor.

The pad of cut meatal cartilage, subcutaneous and fibrous tissue earlier delineated is then removed.

Attention is then turned to widening of the bony posterior canal wall. Using both cutting, and diamond burrs, the bone of the posterior canal is enlarged. A small amount of bone pate is saved for later use.

An incision is made into the anterior canal skin from the inferior to superior, about five millimeters lateral to the tympanic annulus. The skin lateral to the incision is elevated from the anterior canal bony wall, to the point where it becomes adherent to the cartilage of the anterior canal. Skin medial to the incision is elevated several millimeters toward the annulus to protect it from damage during drilling.

The bony anterior canal wall is then recontoured with burrs and suction irrigation. At the medial extent of the recontouring, a soft shoulder is created, about five millimeters from the tympanic membrane. Posterior and anterior canal wall recontouring are merged resulting in a canal that is enlarged and recontoured in all dimensions. The recontoured canal is usually adequate when the lateral diameter is about two centimeters and the mid canal's diameter about one centimeter.

During the recontour procedure, caution is exercised to avoid excessive widening of the ear canal medially into the corda tympani nerve; anteriorly, the temporal mandibular joint; and inferiorly, the facial nerve.

The anterior canal skin flap is replaced over the recontoured canal bone. In order to maintain an adequate meatal opening during healing, a specially designed bolster is used. The bolster is made of a low-resilliance foam covered with a thin layer of Silicone rubber. To secure the bolster a 2-0 Tevdek (a trademark) suture is passed through the superior portion of the posterior canal skin flap and through the superior portion of the previously created fibrous anchor. It is then passed forward back through the inferior portion of the anchor and back through the inferior portion of the posterior canal skin flap.

Bone pate collected earlier is used to fill any exposed mastoid cells.

The post auricular incision is closed with subcuticular Vicryl (a trademark) sutures.

The anterior and posterior canal skin flaps are packed into place with chloramphenicol soaked in Gelfoam Pledges (a trademark). The bolster is introduced into the meatus and tied in place with the Tevdek Suture.

Half inch adhesive strips are placed over the post auricular incision and a mastoid dressing is applied. The dressing is removed by the patient at home the following day.

The bolster remains in place two weeks and is removed by the surgeon. One end of the suture emitting from the posterior canal skin flap is cut flush with the skin, the bolster is removed and the suture is pulled out. The canal is then cleared of Gelfoam (a trademark) and debris with a sterile suction tip.

Antibiotic ear drops are used for several days and the patient is seen every week or two until healing occurs.

Following surgical enlargement of the outer ear canal as described above, an impression of the recontoured canal is made. Typically this impression is taken about 2 to 3 months after surgery, permitting sufficient healing of the surgically modified region. From this impression, the outer housing of the hearing aid device itself is formed, as described below, so as to fit the contours of the surgically enlarged ear canal.

The volume of the surgically enlarged region is of significance in practicing the invention. The volume must be substantial enough to accommodate the hearing aid as described below, and is preferable kept substantially uniform in size and shape from patient to patient to enable more uniformity in procedure and manufacture. Too large a volume is undesirable in that it involves a bulkier device and more extensive surgery. A volume of two cubic centimeters is preferred:

The finished hearing device is moistened with an antibiotic ointment and inserted. If the device is comfortable, it is then worn with progressively longer duration over the next few weeks.

FIGS. 1–3 show the hearing aid device 35 positioned in the surgically modified ear canal. It will be seen that the device 35 is of sufficient size to contain components adequate to provide superior performance, while at the same time, due to the depth which the devices recessed in the ear canal, the device remains essentially invisible to outside observation. The shoulder 37 (FIG. 2) formed by the surgery prevents the device from becoming dislodged and engaging the ear drum, while the exterior contours of the housing 38 of the device, since they are molded to fit the surgically enlarged region, assist in retaining the device firmly and comfortably in position.

As previously mentioned, once all healing of the surgically modified ear canal has taken place, an impression of the ear canal is taken. A general procedure for making an earmold from an impression is described in Chapter 21 the "Basic Course for Independent Study" published by the National Hearing Aid Society. Unlike impressions made from prior art hearing devices, where the impression is taken of the pinna of the ear and continues to the external auditory meatus opening, the impression taken in accordance with the invention is from the ear drum itself out to and beyond the external auditory meatus.

In order to prevent undue pressure on the ear drum during taking of the impression, the material used is of a low viscosity. The low viscosity also permits the impression material to be inserted into the ear canal while allowing the air therein to escape, thus preventing the trapping of air bubbles which might lead to an inaccurate impression. In addition to low viscosity, the impression material should have a high tear strength to prevent it from breaking or tearing during removal, yet must have sufficient flexibility to permit the impression to be readily removed from the ear canal. It is preferred that the material have a relatively short set up time, for example, 5 to 10 minutes, and be dimensionally stable so as to permit the production of an accurate external shape for the housing of the device. Due to the nature of the tissue in the region where the device is positioned in a patient, it is important to have accurate dimensional stability and shape, since the tissue in this region is not as compressible as the outer portions of the ear where prior art devices are typically worn. It has been found that a preferred form of impression material is polyvinylsiloxane.

After the impression is made, the impression itself is trimmed back approximately 2 or 3 millimeters from the ear drum. This conforms to the point where the shoulder is created by the physician during the surgery. A lacquer coat is then brushed onto the impression to provide a smooth finish. The impression is then mounted to an investment casting base and an investment mold is formed using a suitable investment type process. Prior to this, the impression is detailed in such a way as to account for any imperfections and to provide a smooth surface and to remove any rough or sharp edges.

Preferably, in making the investment mold, the impression is mounted to an investment base with a sticky wax, and the assembly is vibrated to insure that the base of the sticky wax has adhered to the impression. The impression is then coated with a suitable separating oil and the investment container is filled with an investment plaster. The plaster is permitted to harden, typically one-half hour, and the impression is removed from the investment housing. After curing of the plaster, such as heating in an oven for approximately 15 to 20 minutes at approximately 92° to 100° C., the mold is removed from the oven and allowed to cool and dry.

Once the mold is completed, the housing for the hearing aid device itself is molded. The housing is formed using a polymer and monomer slurry to form the biocompatible material in which the electronics of the hearing aid are housed. A suitable material is Audacryl, a trademark of Esschem of Essington, N.Y. The formation of the housing or shell is such as to provide a dimensionally accurate exterior surface, and a thin continuous wall thickness with enough strength to prevent the shell from being destroyed and to protect the electronic contents. This is done by subjecting the investment and the shell to a suitable air pressure.

In a preferred procedure, the acrylic monomer and polymer are mixed, slowly to avoid inducing air into the mixture, and the mixture, at a temperature of about 60° F., is poured into the mold. The excess material is poured out after approximately 3 to 5 seconds, with the mold being maintained at a temperature of between 150° to 180° F. This allows for a thin, even coat of acrylic in the mold. Then the polymerization process is begun. The mold container is closed to form an air tight compartment and approximately 30 pounds per square inch of air pressure are injected into the container. This insures a consistent even wall thickness throughout the shell. After approximately one-half hour, the investment container is opened and the shell is trimmed and polished as necessary.

Once the shell or housing 38 is formed, the electronics of the hearing aid device 35 are assembled into the shell. The electronics include a microphone 39, a speaker 41, (or, in the case of a magnetic type of device, a magnetic drive coil) and an amplifier-signal processing section 43. The microphone, speaker and amplifier are all mounted on a ceramic support 46 inside the housing 38. In addition, a face plate 45 with a battery door 47 and battery contacts (not shown) is provided. It is preferred that the device contain a suitable remote control (not shown) to operate the volume and perhaps other aspects of the device, since the device is inserted deeply into the ear canal and is not readily accessible manually. The microphone 39 is mounted in a microphone boot (not shown) of a resilient type of material supported on the face plate 45. The speaker 41, with a suitable shock resistant type outer coating, not shown, is mounted near the end of the device adjacent the ear drum.

Since the interior shape of the ear canal is modified surgically, a more standardized cavity can be developed, thus permitting a more standardized shape and configuration for the hearing aid device 35. This contributes to a more easily manufactured product.

Figure 5:
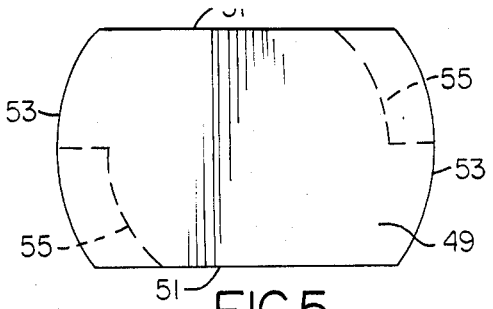
Figure 6:
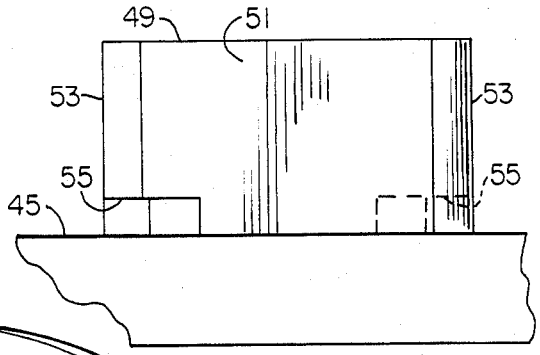
Figure 4:
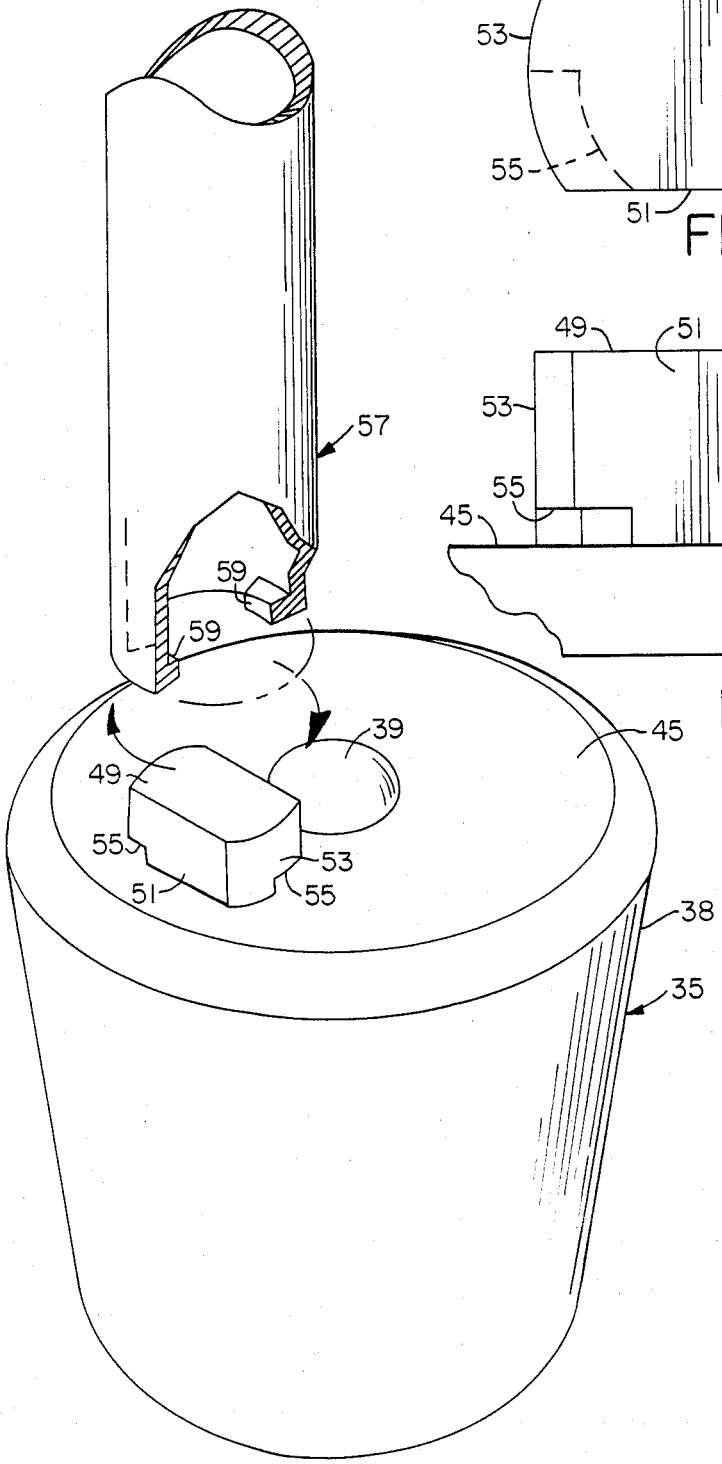
FIG. 4 is an exploded perspective view of a hearing device of the invention showing use of the insertion and removal tool used therewith, and, FIGS. 5 and 6 are schematic top and side views, respectively, illustrating the locking projection used on the hearing device in accordance with the invention.

The face plate 45 of the hearing aid has provision for insertion and removal of the device from the ear. The face plate, which is manufactured of molded plastic, is bonded to the housing material and is provided with a locking projection 49 which extends outwardly from the external planar face of the face plate. Referring to FIGS. 4–6 the locking projection has a pair of opposed planar side 51 and a pair of opposed partially cylindrical sides 53. The cylindrical sides 53 are undercut at 55.

An insertion and removal tool 57 (FIG. 4), which is also cylindrical, is used by the wearer to insert and remove the device. The tool 57 contains a pair of tabs 59 which project inwardly from the inner surface of the cylindrical wall of the tool. The tabs 59, upon turning of the tool clockwise, slide under the undercuts 55 formed in the cylindrical walls of the locking projection.

Once the tabs 59 slide under the walls into the undercuts, by turning the insertion and removal tool one-quarter turn, the entire hearing device 35 may be gently pulled outwardly to remove the device from the ear canal. Conversely, when the device is inserted into the ear canal, the insertion and removal tool may be unlocked from the locking projection by turning in the opposite direction, i.e. counterclockwise, until the tabs slide out from the undercuts and clear the planar sides of the projection. To provide a secure lock, rubber pads or other cushioning, not shown, may be provided on the interior wall of the insertion and removal tool. When the tool is pressed into place, the pads will then be compressed, giving a secure lock. The insertion and removal tool may be provided with an appropriate marker, not shown, to orient the tool in the correct fashion in the wearer's hand. Thus, with the tool properly oriented and inserted into the ear, the tool may be readily seated on the locking projection and then turned as appropriate.

The design of the electronics may be of any suitable configuration to provide the desired hearing assistance. Various hearing aid devices which operate electronically, including devices which are adjustable by remote control, are well known in the art and will not be described in detail herein. Reference is made to the description of an electronic hearing aid in the book "The Hearing Aid, Its Operation and Development", 3rd Edition, 1984 authored by K. W. Berger and published by the National Hearing Aid Society in Chapter 5, entitled "Hearing Aids Today and Tomorrow".

The hearing aid methodology and apparatus described herein provide a significant improvement in the treatment of hearing deficiency. The hearing aid device may be conformed to reside completely within the external auditory canal and can be removed and reinserted easily by the patient. With the device properly inserted, it is not readily visible by external observation. Moreover, the device is capable of accommodating sufficient electronics and power supply as to provide a high quality device without external obtrusiveness. A smaller air chamber may give longer battery life because there is smaller column of air to vibrate. Sound reproduction may be better because of fewer resonances off of soft tissue in the ear canal.

Various modifications of the invention will become apparent to those skilled in the art from the foregoing description and accompanying drawings. Such modifications are intended to fall within the scope of the appended claims.

What is claimed is:

1. A method for treating hearing impairment in a human, comprising, surgically substantially enlarging the external auditory canal in a region proximate the ear drum, and placing in said region an electronic hearing aid having an external housing molded to conform with the shape of said region.

2. A method according to claim 1 wherein a shoulder is surgically formed adjacent the ear drum to provide a stop for locating said hearing aid in said region.

3. A method according to claim 1 wherein said hearing aid is adapted for insertion and removal by the human wearer.

* * * * *